US007918642B2

(12) United States Patent
Leogrande et al.

(10) Patent No.: US 7,918,642 B2
(45) Date of Patent: Apr. 5, 2011

(54) INSTRUMENT PORT SEAL FOR RF MEASUREMENT

(75) Inventors: John A. Leogrande, West Hartford, CT (US); Peter L. Jalbert, Granby, CT (US)

(73) Assignee: United Technologies Corporation, Hartford, CT (US)

( * ) Notice: Subject to any disclaimer, the term of this patent is extended or adjusted under 35 U.S.C. 154(b) by 960 days.

(21) Appl. No.: 11/621,671

(22) Filed: Jan. 10, 2007

(65) Prior Publication Data

US 2008/0187436 A1 Aug. 7, 2008

(51) Int. Cl.
*F01D 25/00* (2006.01)

(52) U.S. Cl. ..... 415/118

(58) Field of Classification Search ..... 416/61; 415/118, 173.1

See application file for complete search history.

(56) References Cited

U.S. PATENT DOCUMENTS

| | | | | | |
|---|---|---|---|---|---|
| 3,761,201 | A * | 9/1973 | Silverstein et al. | 416/232 |
| 3,899,267 | A * | 8/1975 | Dennis et al. | 416/92 |
| 4,330,234 | A * | 5/1982 | Colley | 415/173.2 |
| 4,359,683 | A * | 11/1982 | Chivers | 324/644 |
| 4,384,819 | A * | 5/1983 | Baker | 415/118 |
| 4,752,184 | A * | 6/1988 | Liang | 415/116 |
| 4,946,546 | A * | 8/1990 | Bourgeois-Moine | 216/35 |
| 5,101,165 | A * | 3/1992 | Rickards | 324/662 |
| 5,167,487 | A * | 12/1992 | Rock | 415/173.1 |
| 6,233,822 | B1 * | 5/2001 | Grossklaus et al. | 29/889.1 |
| 6,454,156 | B1 * | 9/2002 | Taras et al. | 228/165 |
| 6,489,917 | B2 | 12/2002 | Geisheimer et al. | |
| 6,856,281 | B2 | 2/2005 | Billington et al. | |
| 7,013,718 | B2 * | 3/2006 | Ingistov et al. | 73/112.03 |
| 7,283,096 | B2 | 10/2007 | Geisheimer et al. | |
| 2006/0088414 | A1 * | 4/2006 | Harivel et al. | 416/61 |
| 2007/0024505 | A1 * | 2/2007 | Geisheimer et al. | 343/700 MS |
| 2008/0054048 | A1 * | 3/2008 | Szela et al. | 228/101 |

* cited by examiner

*Primary Examiner* — Richard Edgar

(74) *Attorney, Agent, or Firm* — Carlson, Gaskey & Olds, P.C.

(57) ABSTRACT

A turbine engine includes a target structure, for example, a rotating turbine blade. A probe is arranged near the target structure for communicating a detection frequency relative to the target structure for gathering information such as tip clearance. A housing is arranged adjacent to the target structure. In one example, the housing is a blade outer air seal. The housing includes a structural material that supports a window material. The window material is arranged between the probe and the target structure. The window material is transparent to the detection frequency permitting the detection frequency to pass through the window to the target structure for measurement of its position relative to the housing. The window material prevents probe contamination and provides a seal between the cooling path and turbine gas flow path.

14 Claims, 3 Drawing Sheets

INSTRUMENT PORT SEAL FOR RF MEASUREMENT

BACKGROUND OF THE INVENTION

This invention relates to a method of mounting a frequency probe in a turbine engine.

Microwave/radio frequency signals have been used to detect, for example, the position of a target component within a turbine engine. A microwave/radio generator produces a signal that is reflected by the target component and processed to detect information such as the position of the target component.

Current methods of instrumentation in a turbine structure require that a hole be drilled in the metal structure to allow the sensor to function. The hole is required to permit communication with a target component. A mechanical connection is required to attach the sensor to the metal structure to prevent leakage. The mechanical connections pose durability issues.

In one example, microwave/radio frequencies are used to detect the clearance of a turbine blade relative to an adjacent housing. The orifice used to accommodate the microwave/radio frequency instrumentation allows air and debris in the turbine gas path to collect within the sensor thereby degrading its performance. The hole also creates a potential pathway for high pressure secondary cooling air used to cool the blade outer air seal to leak through the hole and into the gas path, creating a performance loss.

With prior art methods it is difficult to reliably determine the proximity of the rotating turbine blades relative to the turbine case. What is needed is a method and apparatus for preventing contamination of the sensor and leakage between the cooling path and turbine gas path. What is also needed is a reliable way of establishing an absolute position of the sensor relative to the turbine blades.

SUMMARY OF THE INVENTION

A turbine engine includes a target structure, for example, a rotating turbine blade. A probe is arranged near the target structure for communicating a detection frequency relative to the target structure for gathering information such as tip clearance. A housing is arranged adjacent to the target structure. In one example, the housing is a blade outer air seal. The housing includes a structural material that supports a window material. In one example, the window material is secured within an aperture provided by the structural material of the housing. In one example, the window material is brazed to the structural material. The window material is arranged between the probe and the target structure. The window material is transparent to the detection frequency permitting the detection frequency to pass through the window to the target structure for measurement of its position relative to the housing. In one example, the window material is a metalized aluminum that is brazed to a housing constructed from an Inconel®. The window material prevents probe contamination and provides a seal between the cooling path and turbine gas flow path.

These and other features of the present invention can be best understood from the following specification and drawings, the following of which is a brief description.

DETAILED DESCRIPTION OF THE PREFERRED EMBODIMENT

Figure 1:
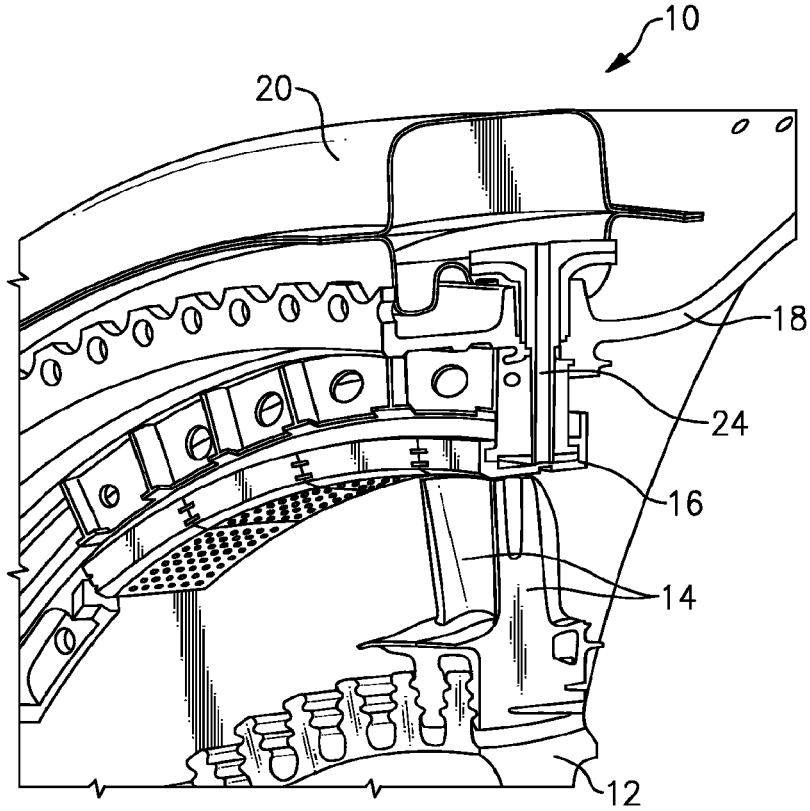
FIG. 1 is a partially broken perspective view of a turbine section of a turbine engine.

A turbine section of a gas turbine engine 10 is shown in FIG. 1. The engine 10 includes a hub 12 having multiple turbine blades 14 secured to the hub 12. A housing, such as blade outer air seal (BOAS) 16, is arranged about the turbine blades 14 near their tips. A casing 18 supports the BOAS 16. Cooling ducts 20 are supported on the casing 18 near the BOAS 16 to control the clearance between the tips and BOAS 16 by selectively controlling cool air through the cooling duct 20, as is known in the art. A probe 24 is supported in the casing 18 and extends to the BOAS 16. The probe 24 is part of a position detection system, shown in FIG. 3, that monitors tip clearance.

Figure 3:
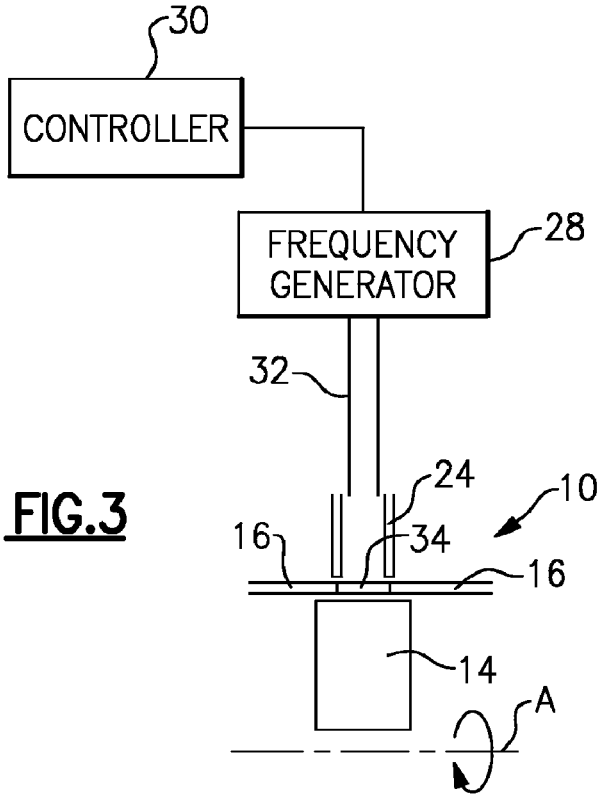
FIG. 3 is a schematic view of the turbine section shown in FIG. 1 and including a position sensing system.

Referring to FIG. 3, the tip clearance detection system includes a frequency generator 28 operable in response to commands from a controller 30. The frequency generator 28 produces a detection frequency including microwave/radio frequencies, in one example. The detection frequency produced by the frequency generator 28 travels along a conduit 32 to the probe 24. It is desirable for the detection frequency to travel generally uninhibited from the probe 24 to the turbine blade 14. As the turbine blades 14 rotate about an axis A, the tip clearance detection system monitors the clearance between the tip of the turbine blades 14 and the BOAS 16. Prior systems have simply provided an aperture in the BOAS 16, which undesirably permits cooling air from the cooling duct 20 to enter the turbine section. A mechanical connection between the conduit 32 and the BOAS 16 was required to prevent leakage, but contributed to durability concerns. Additionally, any holes in the housing enable debris to contaminate the probe 24. It should be understood that the above described detection system can be used to detect other information within the gas turbine engine 10 or other aircraft systems.

Figure 2:
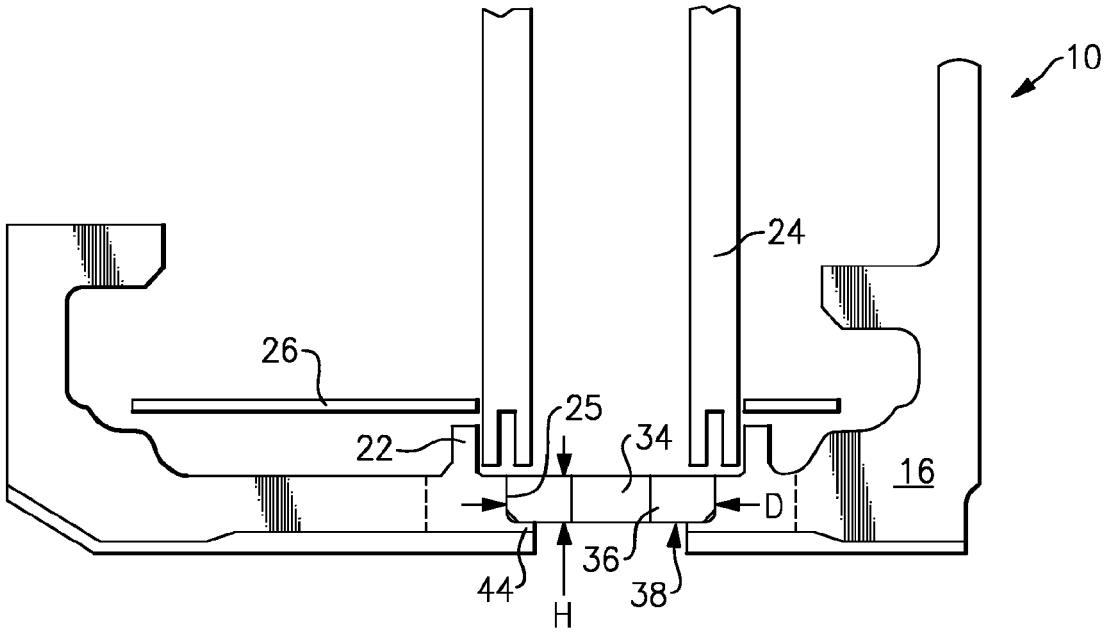
FIG. 2 is and enlarged view of a portion of the cross-section shown in FIG. 1.
Figure 4:
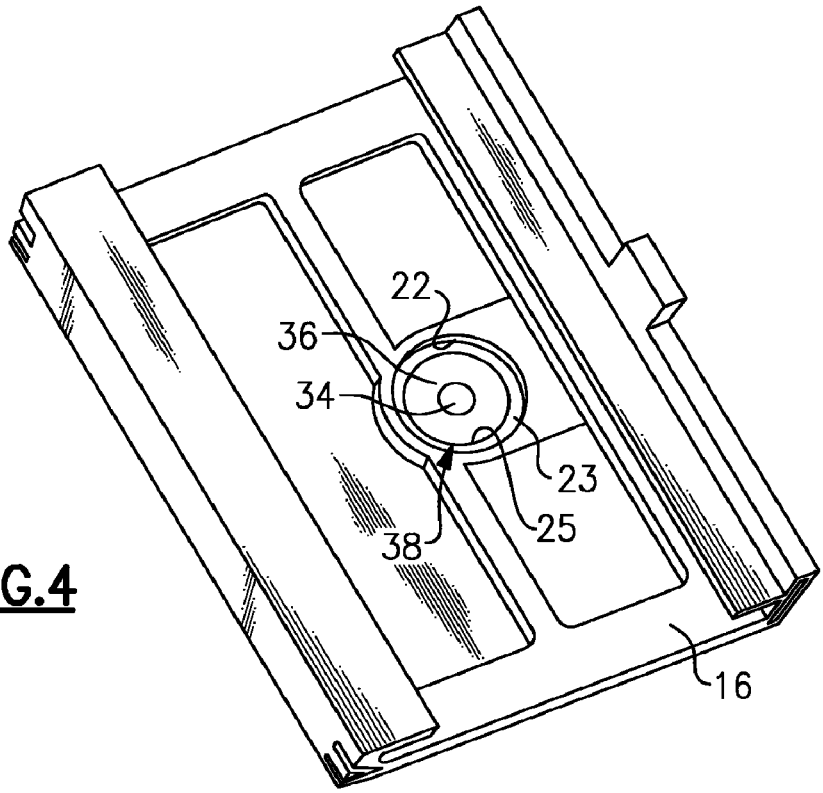
FIG. 4 is a top perspective view of a blade outer air seal.

Referring to FIGS. 2 and 4, the probe 24 is securely retained relative to the BOAS 16 so that the clearance between the BOAS 16 and the adjacent turbine blade 14 can be detected. The BOAS 16 typically includes an impingement plate 26 that is supported between the casing 18 and the BOAS 16. An aperture is provided in the impingement plate 26 to accommodate the probe 24. In the example shown, the BOAS 16 includes a boss that provides a channel ring 22. The channel ring 22 has a recess 23, which is best shown in FIG. 4, to receive an end of the probe 24. In the example, the impingement plate 26 and channel ring 22 retain the probe 24 axially and circumferentially.

The BOAS 16 is typically constructed from a metallic material such as an Inconel®. While Inconel® is a desirable structural material typically used in blade outer air seals, Inconel® blocks the passage of microwave/radio frequencies, which can prevent the communication between the turbine blades 14 and probe 24. In the example, a hole 25 is provided near the end of the probe 24. A window material 34 is supported within the hole 25. The window material 34 is transparent to the detection frequency, permitting communication between the detection frequency and the turbine blade 14. By "transparent" it is meant that the window material 34 permits desired passage of the detection frequency. Said another way, the window material 34 comparatively permits a better quality passage of the detection frequency relative to the housing.

The window material 34 is a polycrystalline, single crystalline or ceramic material, for example. In one example, the window material 34 is a metalized alumina. Other example materials include quartz, diamond, Zirconia toughened alumina, unmetalized alumina, or other materials that are transparent to the detection frequency as known by someone skilled in the art.

Figure 7:
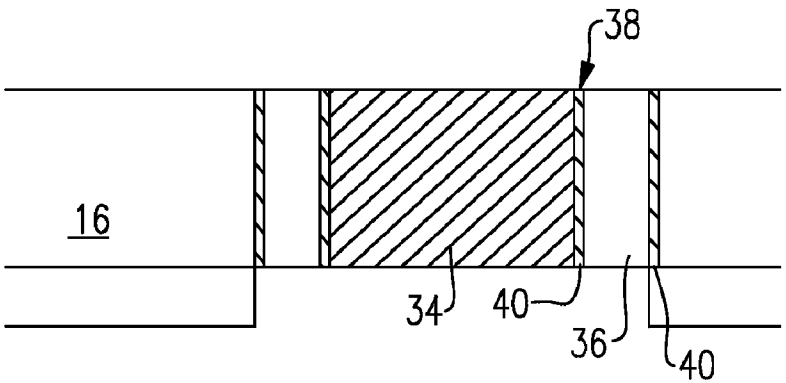
FIG. 7 is an enlarged view of the example port seal subassembly shown in FIGS. 2 and 4.

In the examples shown in FIGS. 2, 4 and 7, the window material 34 is supported by a carrier 36 that provides a subassembly 38. The dimensions of the window material 34 are so small in some applications that it presents assembly difficulties for the turbine engine assembler. By providing a carrier arranged about the window material 34, a larger subassembly 38 is provided that can more easily be manipulated by the assembler.

In one example, a shoulder 44 is provided at one end of the hole to axially locate the subassembly 38. The subassembly 38 including the window material 34 and carrier 36 are machined to a precise height H and diameter D for the typical application. The height H can be precisely machined by polishing, for example, so that an accurate determination of tip clearance can be made. The diameter D can be achieved using an electrical discharge machining process, for example. The window material 34 acts as a reference point to enable more precise measurement of the blade tip clearance. For example, another frequency can be transmitted through the probe 24 that will not pass through the window material 34. The signal reflected from the window material 34 can be used for reference when determining the clearance between the BOAS 16 and blade tip. The carrier 36 may extend radially beyond the channel ring 22 to include the channel ring 22 for better location of the end of the probe 24 relative to the housing 16. Such a carrier 36 is schematically illustrated by the dashed lines in FIG. 2.

Referring to FIG. 7, the window material 34, which is a metalized alumina in the example, is brazed to the carrier 36 using a brazing material 40. In one example, the carrier 36 is an Inconel® like the BOAS 16. The window material 34 and carrier 36 provide a subassembly 38 that is brazed to the BOAS 16 using a brazing material 40. After securing the subassembly 38 to the BOAS 16, the height H of the subassembly 38 can be achieved by machining.

Figure 6:
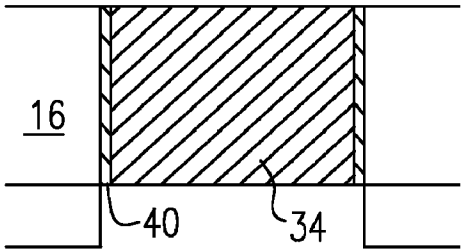
FIG. 6 is another example of a port seal subassembly.
Figure 5:
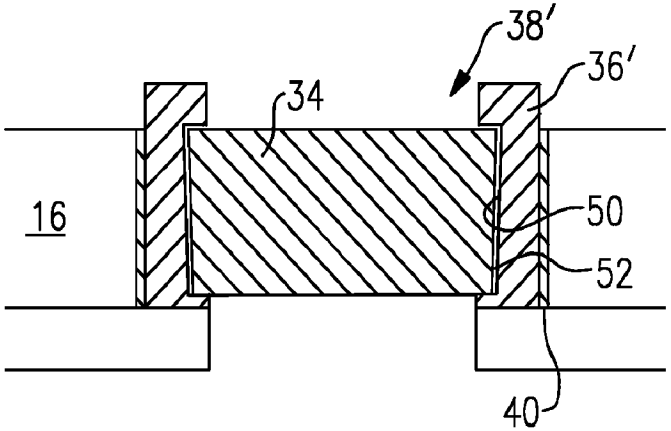
FIG. 5 is one example of a port seal subassembly.

Other example arrangements are shown in FIGS. 5 and 6. Referring to FIG. 5, a subassembly 38' is provided by a carrier 36' having a annular groove 50 machined in its inner diameter. The window material 34 is retained by the carrier 36' and captured within the annular groove 50. The outer diameter of the window material 34 and inner diameter include tapered surfaces 52 for improved retention of the window material 34. The subassembly 38' is secured to the BOAS 16 using a brazing material 40. Referring to FIG. 6, the window material 34 is directly secured to the BOAS 16 using brazing material 40.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A turbine engine comprising:

a target structure;

a probe near the target structure for communicating a detection frequency relative to the target structure to gather information relating to the target structure;

a housing adjacent to the target structure, the housing including a structural material supporting a window material, the window material arranged between the probe and target structure and adapted to be transparent to the detection frequency, wherein the window material is secured to the structural material using a brazed material to provide a unitary structure; and wherein the target structure is a turbine blade, and the housing is a blade outer air seal, wherein the probe is supported by the blade outer air seal, and wherein the blade outer airseal includes a channel ring providing a recess, the probe having an end received in the recess.

2. The turbine engine according to claim 1, wherein the window material is constructed from a metalized alumina.

3. A turbine engine comprising:

a target structure;

a probe near the target structure for communicating a detection frequency relative to the target structure to gather information relating to the target structure;

a housing adjacent to the target structure, the housing including a structural material supporting a window material, the window material arranged between the probe and target structure and adapted to be transparent to the detection frequency, wherein the window material is secured to the structural material using a brazed material to provide a unitary structure; and wherein the window material is secured to a carrier arranged between the window material and the structural material, wherein the carrier includes an annular groove arranged on an inner diameter, the window material retained within the annular groove.

4. The turbine engine according to claim 3, comprising a cooling duct arranged radially outwardly of the housing, the cooling duct carrying a cooling air, the window material blocking fluid communication between the cooling duct and the target structure, the target structure being a turbine blade.

5. The turbine engine according to claim 3, comprising a frequency generator in communication with the probe, the frequency generator providing the detection frequency, which passes through the window material to gather the information.

6. A method of manufacturing a turbine engine comprising the steps of:

a) providing a structure with an aperture;

b) providing a material that includes at least a portion that is transparent to a detection frequency;

c) securing the material within the aperture, including brazing the material to a carrier;

d) arranging a probe near the material for delivering the detection frequency through the material; and e) machining the material and the carrier after performing step c) to establish a desired height of the material corresponding to a reference point.

7. The method according to claim 6, wherein step a) includes drilling a hole to provide the aperture.

8. The method according to claim 6, wherein step a) includes constructing the structure from a metallic material.

9. The method according to claim 6, wherein step b) includes supporting the material in the carrier.

10. The method according to claim 9, wherein step b) includes capturing the window material within an annular groove in the carrier, the annular groove having an inner diameter and the window material having an outer diameter, the inner and outer diameters comprising tapered surfaces.

11. The method according to claim 6, wherein step c) includes blocking the aperture with the material to prevent air flow therethrough.

12. The method according to claim 6, wherein step d) includes aligning the probe with the portion that is transparent.

13. The method according to claim 12, comprising step e) arranging a frequency generator in communication with the probe to deliver the detection frequency.

14. The method according to claim 13, comprising step f) arranging a probe within a housing, the probe aligned with turbine blades.

* * * * *